US010160195B2

(12) United States Patent
Yamamoto et al.

(10) Patent No.: US 10,160,195 B2
(45) Date of Patent: Dec. 25, 2018

(54) FLEXOGRAPHIC PRINTER AND BOX-MAKING MACHINE

(71) Applicant: MITSUBISHI HEAVY INDUSTRIES MACHINERY SYSTEMS, LTD., Hyogo (JP)

(72) Inventors: Osamu Yamamoto, Hiroshima (JP); Kazuya Sugimoto, Hiroshima (JP); Osamu Hatano, Hiroshima (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 0 days.

(21) Appl. No.: 15/505,610

(22) PCT Filed: Sep. 11, 2015

(86) PCT No.: PCT/JP2015/075788
§ 371 (c)(1),
(2) Date: Feb. 21, 2017

(87) PCT Pub. No.: WO2016/063650
PCT Pub. Date: Apr. 28, 2016

(65) Prior Publication Data

US 2017/0291408 A1 Oct. 12, 2017

(30) Foreign Application Priority Data

Oct. 20, 2014 (JP) ..... 2014-213577

(51) Int. Cl.
*B41F 5/24* (2006.01)
*B41F 31/28* (2006.01)
(Continued)

(52) U.S. Cl.
CPC ..... *B41F 5/24* (2013.01); *B31B 50/88* (2017.08); *B41F 17/26* (2013.01); *B41F 19/008* (2013.01);
(Continued)

(58) Field of Classification Search
CPC ..... B41F 5/24
(Continued)

(56) References Cited

U.S. PATENT DOCUMENTS 2,272,406 A * 2/1942 Gurwick ..... B41F 9/066 101/152
2,768,576 A * 10/1956 Dietrich ..... B41F 7/10 101/177
(Continued)

FOREIGN PATENT DOCUMENTS

DE 34030 A1 12/1964
DE 19526574 C1 10/1996
(Continued)

OTHER PUBLICATIONS

International Search Report in International Application No. PCT/JP2015/075788, dated Dec. 1, 2015.
(Continued)

*Primary Examiner* — Anthony Nguyen
(74) *Attorney, Agent, or Firm* — Kanesaka Berner and Partners LLP

(57) ABSTRACT

A flexographic printer is provided with: a printing plate for transferring ink at an ink transfer site to an object to be printed S; an anilox roll for supplying ink to the printing plate at an ink supply site; a plate cylinder on which the printing plate is wound and rotated; and an ink solvent supply unit for supplying a solvent for the ink on the surface of the printing plate in a post-ink transfer region that is downstream of the ink transfer site in the plate cylinder
(Continued)

rotation direction and upstream of the ink supply site in the plate cylinder rotation direction.

13 Claims, 6 Drawing Sheets

(51) Int. Cl.

| | |
|---|---|
| ***B41F 31/02*** | (2006.01) |
| ***B41F 31/13*** | (2006.01) |
| ***B41F 33/00*** | (2006.01) |
| ***B41F 23/04*** | (2006.01) |
| ***B41F 31/20*** | (2006.01) |
| ***B41F 35/02*** | (2006.01) |
| ***B41F 17/26*** | (2006.01) |
| ***B41F 19/00*** | (2006.01) |
| ***B31B 50/88*** | (2017.01) |
| *B41F 1/46* | (2006.01) |
| *B41F 31/00* | (2006.01) |

(52) U.S. Cl.
CPC ..... *B41F 23/0443* (2013.01); *B41F 23/0453* (2013.01); *B41F 23/0466* (2013.01); *B41F 31/001* (2013.01); *B41F 31/027* (2013.01); *B41F 31/13* (2013.01); *B41F 31/20* (2013.01); *B41F 31/28* (2013.01); *B41F 33/0045* (2013.01); *B41F 35/02* (2013.01); *B41F 1/46* (2013.01); *B41F 31/005* (2013.01); *B41P 2235/14* (2013.01); *B41P 2235/26* (2013.01)

(58) Field of Classification Search
USPC ..... 101/419
See application file for complete search history.

(56) References Cited

U.S. PATENT DOCUMENTS

| | | | | |
|---|---|---|---|---|
| 5,154,602 | A * | 10/1992 | Harrison | B41F 5/24 101/351.3 |
| 5,503,069 | A * | 4/1996 | Blim | B41F 35/02 101/216 |
| 5,740,739 | A | 4/1998 | Herold et al. | |
| 5,758,580 | A * | 6/1998 | Murray | B41F 13/42 101/147 |
| 6,055,905 | A * | 5/2000 | Lemaster | B41F 31/007 101/141 |
| 9,073,328 | B2 * | 7/2015 | La Vos | B41J 2/165 |
| 2007/0245916 | A1 | 10/2007 | Bird et al. | |
| 2008/0192105 | A1 * | 8/2008 | Sembower | B41F 5/24 347/124 |
| 2008/0202368 | A1 | 8/2008 | Kajitani et al. | |
| 2010/0210436 | A1 | 8/2010 | Taketsugu | |
| 2013/0249995 | A1 * | 9/2013 | Furukawa | B05C 1/0834 347/21 |
| 2014/0063088 | A1 * | 3/2014 | Shibata | B41J 2/19 347/6 |
| 2016/0001311 | A1 | 1/2016 | Kylling et al. | |

FOREIGN PATENT DOCUMENTS

| | | | |
|---|---|---|---|
| EP | 1964678 | A2 | 9/2008 |
| EP | 2213449 | A1 | 8/2010 |
| JP | 52-32712 | A | 3/1977 |
| JP | 63-116851 | A | 5/1988 |
| JP | 1-208134 | A | 8/1989 |
| JP | 5-138863 | A | 6/1993 |
| JP | 6-947 | A | 1/1994 |
| JP | 7-195656 | A | 8/1995 |
| JP | 9-29929 | A | 2/1997 |
| JP | 10-180988 | A | 7/1998 |
| JP | H10-288784 | A | 10/1998 |
| JP | 2002-292822 | A | 10/2002 |
| JP | 2004-1444 | A | 1/2004 |
| JP | 2008-207458 | A | 9/2008 |
| JP | 2010-83130 | A | 4/2010 |
| WO | 2013/160289 | A1 | 10/2013 |

OTHER PUBLICATIONS

Written Opinion in International Application No. PCT/JP2015/075788, dated Dec. 1, 2015.
Office Action in CN Application No. 201580045142.2, dated Mar. 26, 2018. 17pp.
Extended European Search Report in EP Application No. 15853294.5, dated Feb. 9, 2018. 7pp.
Office Action in JP Application No. 2014-213577, dated Feb. 20, 2018. 9pp.
Office Action in KR Application No. 10-2017-7004493, dated Mar. 14, 2018. 10pp.
Office Action in JP Application No. 2014-213577, dated Jul. 10, 2018, 11pp.

* cited by examiner

FLEXOGRAPHIC PRINTER AND BOX-MAKING MACHINE

RELATED APPLICATIONS

The present application is a National Stage of PCT International Application No. PCT/JP2015/075788, filed Sep. 11, 2015 which claims the benefit of priority from Japanese Patent Application No. 2014-213577, filed Oct. 20, 2014.

TECHNICAL FIELD

The present invention relates to a flexographic printer and a box-making machine having the same.

BACKGROUND ART

A technology of a printer which performs printing using a plate is applied not only to printing of printed matters but also to various fields. In this printer, since a printing atmosphere such as a temperature or humidity influences a print quality, a technology which adjusts the printing atmosphere is suggested so as to obtain a predetermined print quality.

For example, PTL 1 discloses a technology which forms a light emitting layer on a substrate by flexographic printing using a letterpress (printing plate). In this technology, the light emitting layer is formed by printing ink for the light emitting layer, in which polymer organic light-emitting matters are dissolved and dispersed in a solvent, on the substrate. However, the film thickness of ink varies due to the atmosphere of a solvent gas. Accordingly, a technology is suggested in which the solvent gas for ink is supplied to a closed space in which the periphery of the printing plate is covered with a plate cover so as to adjust the atmosphere of the solvent gas.

In addition, since moisture contents influence ink transcription or image formation properties in a case where printing is performed by water based ink in offset printing using lithography, PTL 2 discloses a technology which covers a portion reaching the transfer from ink around a plate cylinder or a blanket cylinder using a cover and adjusts the internal temperature.

Moreover, PTL 3 discloses a technology in which a plate surface portion from inking to transfer is sealed by a cover and concentration of a solvent for ink on the plate surface is constantly maintained so as to obtain a predetermined printing density in gravure printing which uses an intaglio plate.

CITATION LIST

Patent Literature

[PTL 1] Japanese Unexamined Patent Application Publication No. 2010-83130

[PTL 2] Japanese Unexamined Patent Application Publication No. 2008-207458

[PTL 3] Japanese Unexamined Patent Application Publication No. 2002-292822

SUMMARY OF INVENTION

Technical Problem

Meanwhile, in a case where printing is performed with high definition in the flexographic printing which uses the printing plate of the letterpress, it is necessary to increase a line number of the printing plate. In addition, in order to prevent a high-definition print pattern from being crushed, it is necessary to increase the line number of an anilox roll which supplies ink to the surface of the printing plate so as to decrease the film thickness of the ink which is supplied to the printing plate.

Of course, the film thickness of the ink on the printing plate surface becomes thinner by the amount of the transferred ink after the ink is transferred to an object to be printed than before the ink is transferred to the object to be printed. In a case where high-definition printing is performed, since the film thickness of the ink before the ink is transferred is thin, the film thickness of the ink on the printing plate surface after the ink is transferred becomes extremely thin. In general, since water based flexographic ink is used in the flexographic printing, moisture is evaporated from the water based ink on the printing plate surface until new ink is supplied from the anilox roll again after the ink is transferred, and there is a possibility that the printing plate surface may be dried.

If the printing plate surface is dried, even when new ink is supplied from the anilox roll, a sufficient film thickness of ink cannot be obtained, and there is a possibility that it is not possible to ensure a print quality due to deterioration of transcription, variation of ink ride, or the like. In addition, gas of the ink is generated and enriched on the printing plate surface, and there is a possibility that it is not possible to ensure a printing quality. Moreover, even in a case where flexographic ink is an oil based ink, if the solvent for ink is evaporated, similar problems occur.

The technologies disclosed in PTLs 1 to 3 are technologies which adjust the atmosphere of the plate surface until ink is transferred. Accordingly, no attention is paid to the above-described problems in the region of the printing plate after the ink is transferred, and the above-described problems cannot be solved.

A flexographic printer of the present invention and a box-making machine having the same are made in consideration of the above-described problems, and an object thereof is to ensure a print quality even in a case where the line number of the printing plate increases.

In addition, the present invention is not limited to the object, the present invention includes effects according to configurations shown in embodiments of the present invention described below, and another object thereof is to exert effects which cannot be obtained by the related art.

Solution to Problem (1) In order to achieve to the above-described objects, according to an aspect of the present invention, there is provided a flexographic printer, including: a printing plate which transfers ink at an ink transfer site to an object to be printed; an anilox roll which supplies ink to the printing plate at an ink supply site; a plate cylinder around which the printing plate is wound and rotated; and an ink solvent supply unit which supplies a solvent for ink to the surface of the printing plate in a post-ink transfer region which is a downstream of the ink transfer site in a rotation direction of the plate cylinder and an upstream of the ink supply site in the rotation direction of the plate cylinder.

(2) Preferably, the flexographic printer further includes a guide which covers the post-ink transfer region from the outside of the plate cylinder and guides the solvent for ink supplied by the ink solvent supply unit to the surface of the printing plate.

(3) Preferably, the flexographic printer further includes a tray which receives the solvent for ink attached to the guide.

(4) Preferably, the guide and the tray are separately provided from each other.

(5) Alternatively, preferably, the guide and the tray are integrally provided with each other.

(6) Preferably, the ink solvent supply unit includes a storage portion in which the solvent for ink is stored, an ultrasonic mist generator which atomizes the solvent for ink in the storage portion by ultrasonic waves, and a communication portion which communicates with the storage portion and the post-ink transfer region.

(7) Preferably, the flexographic printer further includes a blowing unit which feeds the solvent for ink atomized by the ultrasonic mist generator to the communication portion.

(8) Preferably, the communication portion has a shape which rises and is inclined as the communication portion approaches the post-ink transfer region.

(9) Preferably, the communication portion has a curved crank structure.

(10) Preferably, the ink solvent supply unit includes a two-fluid sprayer which mixes two fluids of the solvent for ink and gas with each other and sprays the mixture.

(11) Preferably, the flexographic printer further includes a temperature-humidity sensor which detects a temperature or humidity of the post-ink transfer region.

(12) Preferably, the flexographic printer further includes a controller which controls a supply amount of the solvent for ink supplied by the ink solvent supply unit based on the temperature or humidity detected by the temperature-humidity sensor.

(13) Preferably, in the flexographic printer, printing is performed using water based ink.

(14) Preferably, the object to be printed is transported while being suctioned.

(15) A box-making machine of the present invention includes the flexographic printer.

(16) Preferably, the box-making machine further includes a dry unit which heats and dries the printed object-to-be-printed is provided in the flexographic printer in the downstream in the transport direction of the object to be printed.

Advantageous Effects of Invention

According to the flexographic printer of the present invention, since the ink solvent supply unit supplies the solvent for ink to the surface of the printing plate in a post-ink transfer region which is a downstream of the ink transfer site in a rotation direction of the plate cylinder and an upstream of the ink supply site in the rotation direction of the plate cylinder, particularly, the solvent for ink is supplied to the surface of the printing plate in the post-ink transfer region in which ink is easily dried in a case where the line number of the printing plate increases, and it is possible to ensure the print quality even in the case where the line number of the printing plate increases.

In addition, according to the box-making machine of the present invention, since the box-making machine includes the flexographic printer, the above-described effects can be obtained.

BRIEF DESCRIPTION OF DRAWINGS

FIG. 5A shows the moisture supply unit when water supply is stopped, FIG. 5B shows the moisture supply unit when water is supplied, and FIG. 5C is the moisture supply unit when the water is drained.

DESCRIPTION OF EMBODIMENTS

Hereinafter, an embodiment according to a flexographic printer of the present invention will be described. In the present embodiment, the direction of gravity is the lower side, and the direction opposite to the direction of gravity is the upper side.

I. First Embodiment

Hereinafter, a flexographic printer according to a first embodiment will be described.

[1. Configuration]

The flexographic printer is used to print an object to be printed such as a corrugated fiberboard or a wrapping paper using various inks such as water based ink or UV ink. In the present embodiment, a flexographic printer which prints a corrugated fiberboard using water based ink is described as an example. Specifically, a flexographic printer which is applied to a box-making machine which manufactures (makes) a corrugated box from a corrugated fiberboard is described.

[1-1. Overall Configuration of Box-Making Machine]

First, the overall configuration of the box-making machine will be described.

Figure 4:
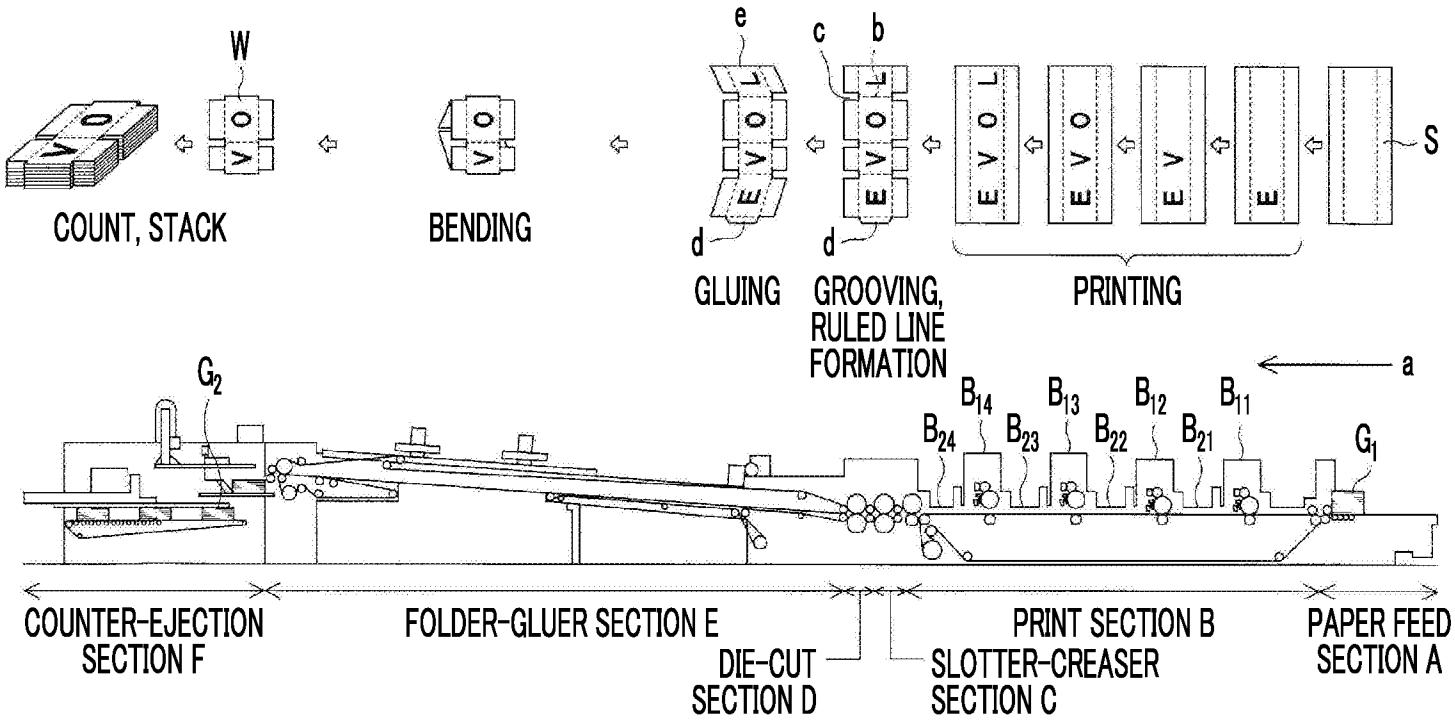
FIG. 4 is a side view schematically showing the overall configuration of a box-making line in a box-making machine to which the flexographic printer according to the first embodiment of the present invention is applied.

As shown in FIG. 4, in the box-making machine, a paper feed section A, a print section B, a slotter-creaser section C, a die-cut section D, a folder-gluer section E, and a counter-ejector section F are provided in this order from the upstream side of a process (box-making line). In FIG. 4, the right side is the upstream of the process, the left side is the downstream of the process, and a corrugated fiberboard S is transported in the direction of an arrow a to make a box.

In the paper feed section A, corrugated fiberboards S are stacked so as to be arranged in the same direction. In the paper feed section A, corrugated fiberboards S from the lower layer side of a plurality of stacked corrugated fiberboards S (corrugated fiberboard group $G_1$) are fed to the print section B one by one.

In the print section B, printing is performed on the corrugated fiberboard S, and ink on the corrugated fiberboard S is dried. Here, for example, printing is performed on the corrugated fiberboard S by each color of print units $B_{11}$, $B_{12}$, $B_{13}$, $B_{14}$ corresponding to four colors of CMYK, and the ink on the corrugated fiberboard S is heated and dried by the dry units $B_{21}$, $B_{22}$, $B_{23}$, and $B_{24}$ provided on the immediately downstream of the print units $B_{11}$, $B_{12}$, $B_{13}$, $B_{14}$. The print units $B_{11}$, $B_{12}$, $B_{13}$, $B_{14}$ are configured similarly to each other except that the used colors of ink are different from each other, and the dry units $B_{21}$, $B_{22}$, $B_{23}$, and $B_{24}$ are configured similarly to each other.

Moreover, in the print section B, in addition to ink of four colors being used, ink of various colors such as a single color or six colors may be used. In this case, the print units and the dry units corresponding to the number of the colors of the used ink are provided. However, some dry units or all dry units may be omitted.

In the slotter-creaser section C, grooving and formations of rule lines are performed at a plurality of sites of the corrugated fiberboard S in the transport direction, the ruled lines b and the grooves c (the reference numerals are assigned to only one site) are formed, and an adhesion piece d is formed. In addition, in the die-cut section D, drilling is performed to form a handle hole or an air hole.

In addition, although it is not shown, a so-called wrap-around caser may be used in the box-making machine. The wrap-around caser is a machine in which the slotter creaser section C is not provided, and in the die-cut section D, drilling and punching are performed to form a handle hole, an air hole, or the like, grooving and formation of a ruled line are performed to prepare a box having a specific shape, the corrugated fiberboard S which has been printed and subjected to the grooving and the formation of the ruled line is introduced into a manufacturing line of a product, products are stacked on the corrugated fiberboard S to be loaded, a box is formed to enclose the products, and the products are wrapped.

In the folder-gluer section E, glue is applied to the adhesion piece d of the corrugated fiberboard S, the adhesion piece d is bent and overlaps with a side plate e so as to be bonded to the side plate e, and a corrugated box W in a flat condition which can be unfolded in a square cylindrical shape.

In the counter-ejector section F, the number of the corrugated boxes W is counted, and the corrugated boxes W are stacked so as to be arranged in the same direction. In addition, the stacked corrugated boxes (corrugated box group $G_2$) are bound and packed every predetermined number of corrugated boxes so as to be shipped.

In the present embodiment, the flexographic printer can be applied to each of the print units $B_{11}$, $B_{12}$, $B_{13}$, and $B_{14}$ of the print section B. Here, the flexographic printer is applied to each of the print units $B_{11}$, $B_{12}$, $B_{13}$, and $B_{14}$. In descriptions below, the flexographic printer will be described in terms of one of the print units $B_{11}$, $B_{12}$, $B_{13}$, and $B_{14}$.

[1-2. Flexographic Printer]

First, in the flexographic printer, a basic configuration for performing printing on the corrugated fiberboard S will be described.

Here, a chamber-type flexographic printer is described as an ink supply method of the flexographic printer. However, other ink supply methods may be adopted, which include a two-roll type method which supplies ink to a printing plate of a plate cylinder using a fountain roller and an anilox roller which are provided so as to be immersed into ink stored in an ink pan, a doctor type method which supplies ink to a printing plate of a plate cylinder using an anilox roller which is provided so as to be immersed into ink stored in an ink pan and a doctor blade which scrapes off ink on the peripheral surface of the anilox roller, or the like.

In addition, a general ink supply method in which an ink supply unit is provided above the corrugated fiberboard S is described as an example. However, an ink supply method in which an ink supply unit is provided below the corrugated fiberboard S may be adopted.

[1-2-1. Basic Configuration]

Figure 1:
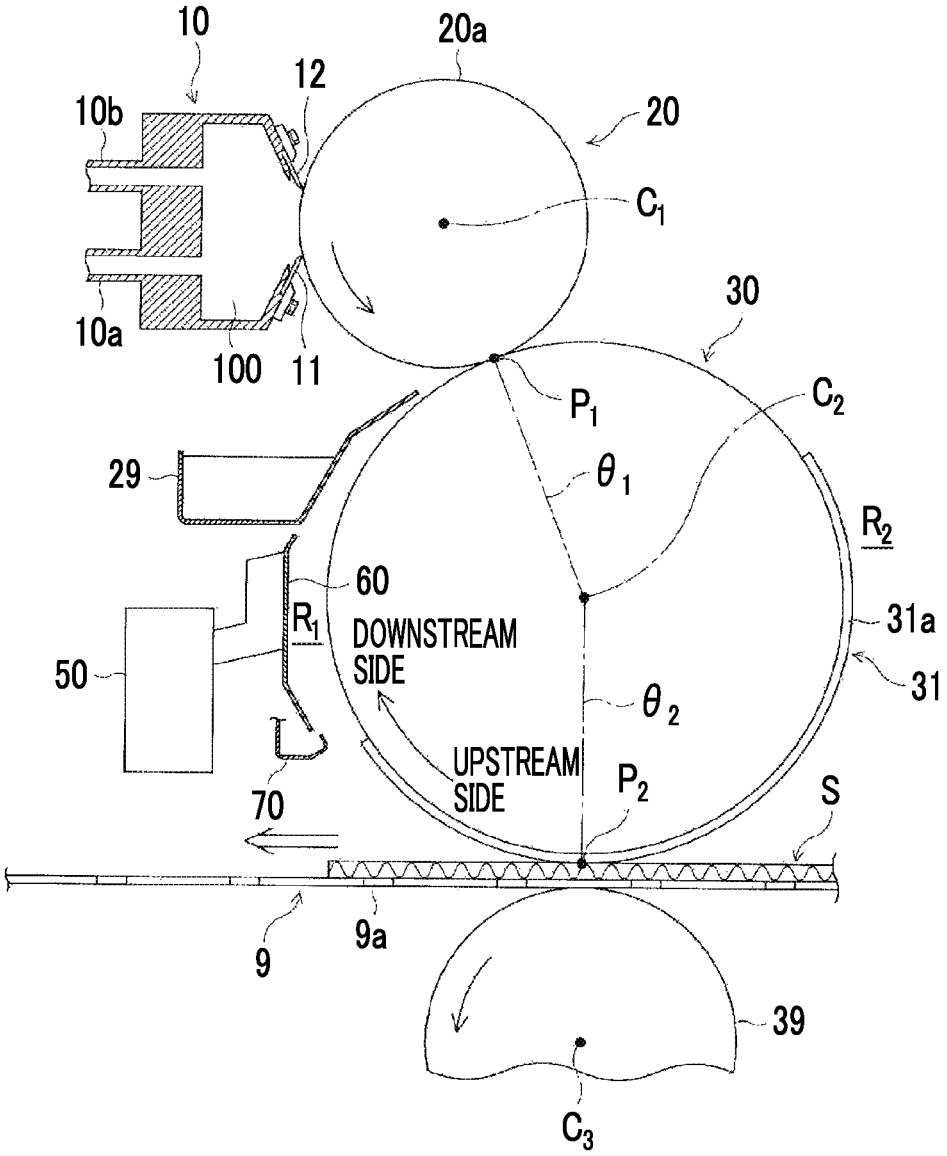
FIG. 1 is a side view schematically showing the overall configuration of a flexographic printer according to a first embodiment of the present invention.

As shown in FIG. 1, the flexographic printer includes an ink chamber 10, an anilox roll 20, an ink receiving pan 29, a plate cylinder 30 in which a printing plate 31 is wound around the outer periphery, and a receiving roll 39.

An axial center $C_1$ of the anilox roll 20, an axial center $C_2$ of the plate cylinder 30, and an axial center $C_3$ of the receiving roll 39 are provided so as to be parallel to each other, and are disposed in an apparatus width direction (hereinafter, simply referred to as a "width direction") of the flexographic printer. In addition, the width direction is a direction orthogonal to the transport direction (indicated by a double arrow in FIG. 1) of the corrugated fiberboard S.

As shown by a single arrow, the anilox roll 20, the plate cylinder 30, and the receiving roll 39 are rotated in directions opposite to each other by adjacent cylinders or rolls, and rotating speeds of the anilox roll 20, the plate cylinder 30, and the receiving roll 30 correspond to the transport speed of the corrugated fiberboard S.

The ink chamber 10 has an internal space 100 in which ink is stored, and is connected to an ink tank (not shown) via an ink supply pipe 10*a* and an ink discharge pipe 10*b*. Ink is pressure-fed by a pump (not shown), flows through the ink supply pipe 10*a* from the ink tank, and is supplied to the internal space 100. The ink overflowed from the internal space 100 flows through the ink discharge pipe 10*b* and is returned to the ink tank.

A doctor blade 11 and a seal blade 12 are attached to the ink chamber 10. The distal end of each of the blades 11 and 12 is in contact with a peripheral surface 20*a* of the anilox roll 20 or is attached so as to have a minute gap with the peripheral surface 20*a*.

The anilox roll 20 attaches ink to the printing plate 31 of the plate cylinder 30. Fine recessed portions (also referred to as "reliefs" or "cells") are engraved on the peripheral surface 20*a* of the anilox roll 20.

Ink is supplied from the ink chamber 10 to the peripheral surface 20*a* of the anilox roll 20, the ink is accommodated in the recessed portions of the peripheral surface 20*a*, and ink which does not enter the recessed portions is scrapped off by the above-described doctor blade 11.

The recessed portions are formed to be finer (with a shallower depth) as the line number of the printing plate increases. In other words, in most cases, the ink storage amount of the recessed portions decreases as the line number of the printing plate 31 increases. In addition, the "line number" is a measure which indicates the accuracy of printing, and means the number of rows of halftone dots for a certain range (predetermined length).

The ink receiving pan 29 is configured to receive ink which is dropped (flows downward) when the ink is supplied from the ink chamber 10 to the anilox roll 20 and ink which is scraped off by the doctor blade 11, or to receive ink and a washing liquid when the ink chamber is cleaned. Accordingly, the ink receiving pan 29 is provided below the ink supply site from the ink chamber 10 to the anilox roll 20. In addition, the disposition site of the ink receiving pan 29 will be described in detail below.

The plate cylinder 30 is also referred to a printing cylinder, and the printing plate 31 is wound around the outer periphery of the plate cylinder 30.

The plate cylinder 30 is provided so that the printing plate 31 on the outer periphery comes into contact with the anilox roll 20 at a predetermined pressure at the ink supply site $P_1$. That is, ink is supplied from the anilox roll 20 to the printing plate 31 of the plate cylinder 30 at the ink supply site P1.

In addition, the printing pressure of the plate cylinder 30 is adjusted such that the printing plate 31 on the outer periphery comes into contact with the corrugated fiberboard S at an ink transfer site $P_2$ at a predetermined pressure (for example, a pressure corresponding to a so-called kiss-touch). Accordingly, ink is transferred from the printing plate 31 of the plate cylinder 30 to the corrugated fiberboard S at the ink transfer site $P_2$.

The printing plate 31 is a flexible letterpress formed of rubber, resin, or the like. Similarly to the above-described anilox roll 20, in the printing plate 31, the amount of ink to be loaded decreases as the line number increases. That is, in most cases, the film thickness of the ink on the surface 31*a* of the printing plate 31 (hereinafter, referred to as a "printing plate surface") is reduced as the line number increases.

The receiving roll 39 is provided in a state where a transport belt 9 is interposed between the plate cylinder 30 and the receiving roll 39. When the ink is transferred, the corrugated fiberboard S is transported while being interposed between the transport belt 9 and the plate cylinder 30.

The transport belt 9 has air permeability. Specifically, a large number of ventilation holes 9*a* (in FIG. 1, the size is exaggerated for easiness of understanding) are formed on the transport belt 9. The ventilation holes 9*a* are formed to transport the corrugated fiberboard S while suctioning the corrugated fiberboard S onto the transport belt 9. Accordingly, a suction device (not shown) for suctioning on the side opposite to the side on which the corrugated fiberboard S is placed (in this case, the lower side) is provided on the transport belt 9.

Moreover, although it is not shown, a configuration may be used, in which a plurality of transport rollers are used instead of the transport belt 9, and the corrugated fiberboard S is transported while being interposed between the transport rollers and the plate cylinder 30. In this case, since the elongation of the transport belt 9 does not influence the transport of the corrugated fiberboard S, it contributes to high-precision printing.

[1-2-2. Configuration for Supplying Ink Solvent]

Next, in the flexographic printer, a moisture supply unit 50 and the peripheral configuration thereof will be described, and the moisture supply unit 50 is an ink solvent supply unit for supplying a solvent for ink (hereinafter, simply referred to as an "ink solvent") on the printing plate surface 31*a*. Since the flexographic printer uses water based ink, water corresponds to the ink solvent.

The moisture supply unit 50 supplies moisture to the printing plate surface 31*a* in a post-ink transfer region $R_1$ which is a downstream of the ink transfer site $P_2$ in the rotation direction of the plate cylinder 30 and an upstream of the ink supply site $P_1$ in the rotation direction of the plate cylinder 30. In addition, moisture is not supplied to a pre-ink transfer region $R_2$ which is a downstream of the ink supply site $P_1$ in the rotation direction of the plate cylinder 30 and an upstream of the ink transfer site $P_2$ in the rotation direction of the plate cylinder 30.

Here, based on the axial center $C_2$ of the plate cylinder 30, the post-ink transfer region $R_1$ means a space which is positioned on the upstream side of a phase corresponding to the ink supply site $P_1$ (hereinafter, referred to as an "ink supply phase") $\theta_1$ in the rotation direction of the plate cylinder based on the rotation direction of the plate cylinder 30 and on the downstream side of a phase (hereinafter, referred to as an "ink supply phase") $\theta_2$ corresponding to the ink transfer site $P_2$ based on the rotation direction of the plate cylinder 30, and is positioned along the periphery of the plate cylinder 30 on the outer portion of the plate cylinder 30. Meanwhile, the pre-ink transfer region $R_2$ means a region except for the post-ink transfer region $R_1$ of the space along the periphery of the plate cylinder 30 outside the plate cylinder 30.

In the vicinity of the moisture supply unit 50, a guide 60 which covers the post-ink transfer region $R_1$ from the outside of the plate cylinder 30 and guides moisture supplied by the moisture supply unit 50 to the printing plate surface 31*a*, the ink receiving pan 29 provided above the guide 60, and a tray 70 which receives water droplets attached to the guide 60 are provided. In addition, the guide 60 and the tray 70 are separately provided from each other.

Figure 2:
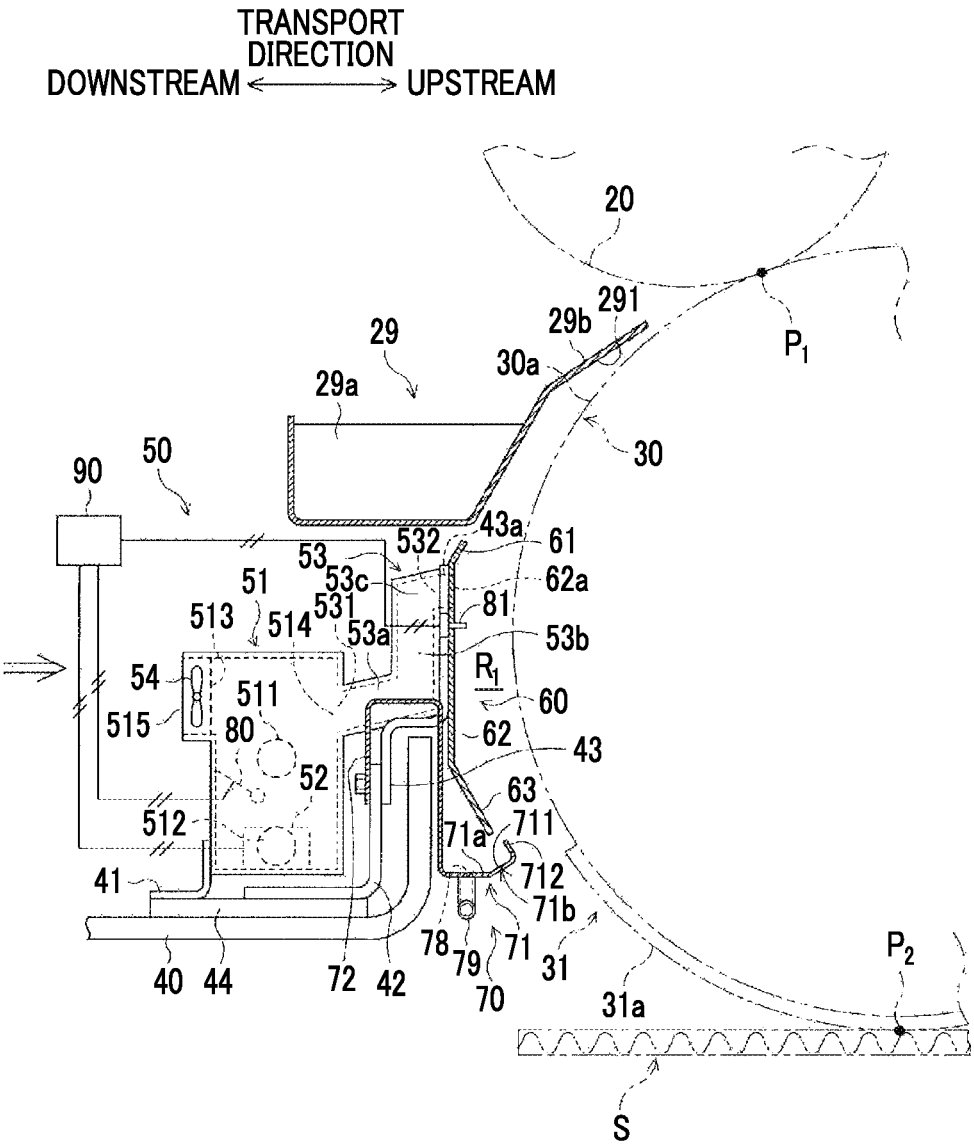
FIG. 2 is a main portion enlarged view showing a main portion of FIG. 1 in an enlargement manner.

In addition, as shown in FIG. 2, as sensors which detect various parameters used in the control of the amount of moisture (mist) supplied to the post-ink transfer region $R_1$, a water level sensor 80 which detects the amount of the water stored in a storage portion 51 and a temperature-humidity sensor 81 which detects the temperature and humidity of the post-ink transfer region $R_1$ are provided. A controller 90 which performs a control based on various parameters detected by the sensors 80 and 81 is provided.

In addition, a structure is exemplified in which the moisture supply unit 50, the guide 60, and the tray 70 are supported to a main bracket 40 which is supported by a side frame (not shown) or the like via a support base 44 using brackets 41, 42, and 43. However, various support structures may be adopted according to limitation of brackets provided in the vicinity thereof or the layout.

Hereinafter, the moisture supply unit 50, the peripheral configuration, and the controller 90 will be described in this order.

[1-2-2-1. Moisture Supply Unit]

The moisture supply unit 50 includes the storage portion 51 in which water is stored, a ultrasonic mist generator 52 which atomizes water in the storage portion by ultrasonic waves, and a communication portion 53 which communicates with the storage portion 51 and the post-ink transfer region $R_1$.

<Storage Portion>

The storage portion 51 stores water for ink solvent. Here, the storage portion 51 is formed in a rectangular parallelepiped shape. However, as the shape of the storage portion 51, various shapes can be adopted according to the surrounding structure and the layout. Here, as shown in FIG. 3, a plurality of (here, three) storage portions 51 are provided so as to be arranged in the width direction.

As shown in FIG. 2, in the storage portion 51, a fan which serves as a blowing unit, and a water level sensor 80 which detects the height (water level) of the stored water are provided. The fan 54 blows air above the water stored in the storage portion 51. Here, an axial flow blower type fan is exemplified as the fan 54. Moreover, although it is not shown, a blower may be used as the blowing unit instead of or in addition to the fan 54. A centrifugal blower type blower can be used as the blower. Moreover, information of the water level detected by the water level sensor 80 is transmitted to the controller 90. In addition, the storage portion 51 includes two water-flow ports 511 and 512 through which the stored water flows and three opening portions 513, 514, and 515 through which air above the water surface in the storage portion 51 flows.

In the two water-flow ports 511 and 512, the water-flow port positioned at the upper portion (hereinafter, referred to as an "upper water-flow port") 511 functions as a drain port when the water in the storage portion 51 ascends, and the water-flow port positioned at the lower portion (hereinafter, referred to as a "lower water-flow port") 512 functions as a water supply-drain port of the storage portion 51.

Figure 3:
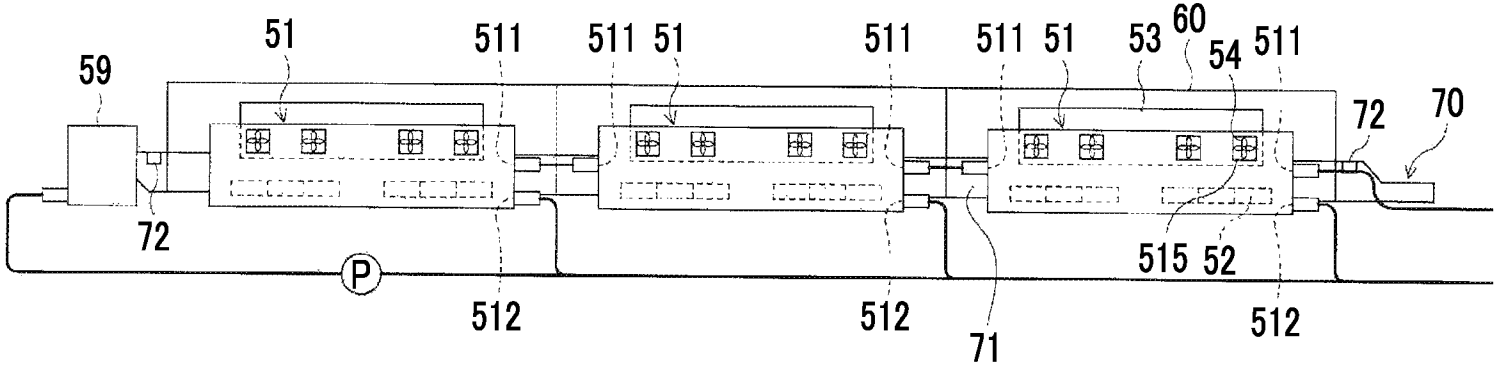
FIG. 3 is a rear view when main portions including a moisture supply unit (ink solvent supply unit) of the flexographic printer according to the first embodiment of the present invention are extracted and are viewed from the rear surface (the downstream in a transport direction) side.

Here, as shown in FIG. 3, the upper water-flow ports 511 of the adjacent storage portions 51 are connected to each other, and the lower water-flow ports 512 of the storage portions 51 are connected to the water tank 59 in which water is stored. A water supply source (not shown) is connected to the upstream side of the water tank 59, and a pump P for supplying and draining water is interposed between the water tank 59 and the lower water-flow port 512. In addition, a plurality of (here, four) fans 54 are provided in one storage portion 51 so as to be arranged in the width direction. According to the juxtaposition of the fans 54, a plurality of suction opening portions 515 (the reference numeral is assigned to only one suction opening portion) described below are provided so as to be arranged in the width direction. In addition, FIG. 3 is a view when main portions including the moisture supply unit 50 are viewed in the direction (downstream side in the transport direction) shown by the double arrow of FIG. 2.

As shown FIG. 2, winds generated by the fan 54, that is, air flows through one opening portion (hereinafter, referred to as a "fan opening portion) 513 among the three opening portions 513, 514, and 515. Another opening portion (hereinafter, referred to as a "duct opening portion") 514 is a communication port between the inside of the communication portion 53 and the inside of the storage portion 51, and the mist generated by the ultrasonic mist generator 52 is fed to a communication passage 53 by air blown from the fan 54. Still another opening portion (hereinafter, referred to as a "suction opening portion") 515 is provided to suction the outside air from the back face (the downstream side in the transport direction) of the fan 54.

<Ultrasonic Mist Generator>

The ultrasonic mist generator 52 is also referred to as a nebulizer and is provided in water stored in the storage portion 51. For example, a piezoelectric ceramics vibrator can be used as the ultrasonic mist generator 52. In this case, vibration energy of ultrasonic waves generated by applying high-frequency alternating voltages to the piezoelectric ceramics vibrator is transmitted to the water surface, and mist (minute water droplets floating in the air) can be generated from the water surface.

Here, as shown in FIG. 3, a plurality of (here, six) ultrasonic mist generators 52 are provided in one storage portion 51 so as to be arranged in the width direction.

<Communication Portion>

As shown in FIG. 2, the communication portion 53 communicates a space above the water surface in the storage portion 51 and the post-ink transfer region $R_1$, and is a duct through which mist generated by the ultrasonic mist generator 52 flows.

The communication portion 53 includes an opening portion on the storage portion 51 side (hereinafter, referred to as a "storage portion-side opening portion") 531 and an opening portion on the plate cylinder 30 side (hereinafter, referred to as a "plate cylinder-side opening portion") 532. The storage portion-side opening portion 531 is provided so as to overlap the duct opening portion 514 of the storage portion 51 in an elevation view, and the plate cylinder-side opening portion 532 is provided so as to overlap opening portions 43*a* and 62*a* described below in an elevation view.

The communication portion 53 has a shape which rises and is inclined as the communication portion approaches the post-ink transfer region $R_1$. Moreover, the communication portion 53 includes a curved crank structure. As shown in FIG. 3, one communication portion 53 (the reference numeral is assigned to only one communication portion) is provide with respect to one storage portion 51.

Specifically, as shown FIG. 2, the communication portion 53 includes a first communication portion 53*a*, a second communication portion 53*b*, and a third communication portion 53*c* in the order in which the mist fed by the fan 54 flows. The first communication portion 53*a* and the second communication portion 53*b* are oriented so as to intersect each other and are connected to each other, and similarly, the second communication portion 53*b* and the third communication portion 53*c* are oriented so as to intersect each other and are connected to each other. In the way, the communication portion 53 has a crank structure.

The first communication portion 53*a* has a shape in which the height position rises and is inclined from the storage portion 51 side toward the post-ink transfer region $R_1$. The second communication portion 53*b* extends in the vertical direction. Similarly to the first communication portion 53*a*, the third communication portion 53*c* is provided such that the height position provided toward the post-ink transfer region $R_1$ rises.

In addition, a drain port is provided in the communication portion 53, and a drain pipe is connected to the drain port.

[1-2-2-2. Peripheral Configuration of Moisture Supply Unit]

Hereinafter, the guide 60, the ink receiving pan 29, and the tray 70 which are the peripheral configurations of the moisture supply unit 50 will be described. Here, a structure in which the guide 60 and the ink receiving pan 29 cooperate with each other to guide mist (moisture) to the printing plate surface 31*a* is exemplified, and the ink receiving pan 29, the guide 60, and the tray 70 will be described in this order.

<Ink Receiving Pan>

The ink receiving pan 29 includes a container-shaped main body portion 29*a* which has an opening in the upper portion, and an extension portion 29*b* which is provided to extend from the main body portion 29*a* toward the ink supply site $P_1$. Each of the surface portion of the main body portion 29*a* on the plate cylinder 30 side and the extension portion 29*b* (hereinafter, the surface portion and the extension portion 29*b* are collectively referred to as a "plate cylinder-side surface portion 291") functions as a cover which covers the plate cylinder 30 from the outside. That is, the plate cylinder-side surface portion 291 is positioned above the guide 60 and is disposed such that the post-ink transfer region $R_1$ is along the peripheral surface 30*a* of the plate cylinder 30.

<Guide>

The guide 60 cooperates with the ink receiving pan to function as a cover which covers the post-ink transfer region $R_1$ from the outside of the plate cylinder 30. The guide 60 is disposed along the peripheral surface 30*a* of the plate cylinder 30 in a state where the post-ink transfer region $R_1$ is interposed between the guide 60 and the plate cylinder 30. In addition, the guide 60 is made of stainless steel having antirust properties.

Specifically, the guide 60 is formed to be bent along the peripheral surface 30*a* of the plate cylinder 30, and can be roughly divided into portions such as an upper guide portion 61, an intermediate guide portion 62, and a lower guide portion 63 in this order from above.

The intermediate guide portion 62 is provided to extend in the vertical direction. The guide opening portion 62*a* is formed in the intermediate guide portion 62. The guide opening portion 62*a* is provided so as to overlap the plate cylinder-side opening portion 532 of the communication portion 53 and the opening portion 43*a* of the bracket 43 in an elevation view, and is a supply port through which the mist from the moisture supply unit 50 is supplied to the post-ink transfer region $R_1$.

With respect to the intermediate guide portion 62, the upper guide portion 61 is formed to be inclined toward the upstream side in the transport direction as the upper guide portion 61 is directed upward, and the lower guide portion 63 is formed to be inclined toward the upstream side in the transport direction as the lower guide portion 63 is directed downward.

Here, a space is formed between the upper guide portion 61 and the ink receiving pan 29, and the extension plane of the upper guide portion 61 and the extension plane of the plate cylinder-side surface portion 291 in the ink receiving pan 29 are disposed so as to overlap each other or approach each other. According to this disposition, the post-ink transfer region $R_1$ is surrounded by the guide 60 and the plate cylinder-side surface portion 291 of the ink receiving pan 29 over a wide range from the outside of the plate cylinder 30.

In addition, the installation site of the ink receiving pan 29 is set according to the installation sites of the ink chamber 10 (refer to FIG. 1) and the anilox roll 20. In view of this, in a case where the installation site of the ink receiving pan 29 is changed due to adoption of other ink supply methods or other layouts, preferably, the upper guide portion 61 of the guide 60 extends to the region corresponding to the plate cylinder-side surface portion 291 of the ink receiving pan 29.

Here, as shown in FIG. 3, a plurality of (here, three) guide portions 60 (the reference numeral is assigned to only one guide portion) are provided in a divided manner in the width direction. In addition, the guide portions 60 may be integrally provided in the width direction.

<Tray>

As described above, the tray 70 receives water droplets which are attached to the guide 60. Hereinafter, the detailed configuration of the tray 70 will be described. In addition, it is to be noted that the water droplets to be collected by the tray 70 have sizes which are dropped by the gravity while the minute water droplets which are components of the mist float in air. For example, if the minute water droplets of the mist are attached to the guide 60 to be agglomerated, the minute water droplets become large water droplets and are dropped (flow downward) due to the gravity.

As shown in FIG. 2, the tray 70 includes a tray portion 71 which receives water droplets, and an attachment portion 72 which is attached to the bracket 42. Here, the attachment portion 72 has a shape in which the open side of a U shape in a longitudinal section is directed downward so as not to interfere with the main bracket 40. In addition, the tray 70 is made of stainless steel having antirust properties.

As shown in FIG. 3, a plurality of (here, three) divided tray portions 71 (the reference numeral is assigned to only one tray portion) are provided so as to be connected in the width direction. The attachment portion 72 is provided in each of both ends of the tray portions 71 in the longitudinal direction (width direction). In addition, the trays 70 may be integrally provided in the width direction. In this case, compared to a structure where the plurality of tray portions 71 are connected to each other, it is possible to prevent water leakage from the connected sites.

As shown in FIG. 2, the tray portion 71 is provided below the guide 60. The tray portion 71 includes a horizontal portion 71*a* which extends in the horizontal direction, and a bent portion 71*b* which is formed to be bent on the plate cylinder 30 side with respect to the horizontal portion 71*a*.

A drain port 78 through which the collected water droplets are drained is provided in the horizontal portion 71*a*. A drain pipe 79 is connected to the drain port 78.

The bent portion 71*b* has a shape in which the open side of a V shape in a vertical section is directed toward the downstream side in the transport direction, and includes a first bent portion 711 on the horizontal portion 71*a* side and a second bent portion 712 which is provided above the first bent portion 711. The first bent portion 711 is provided so as to be positioned below the lower end (the upstream end in the transport direction) of the lower guide portion 63 in the guide 60, is bent so as to be positioned above as it approaches the plate cylinder 30, and corresponds to the lower side of the V shape. The second bent portion 712 is bent so as to be positioned above as it is separated from the plate cylinder 30 side, and corresponds to the upper side of the V shape. The second bent portion 712 is disposed along the peripheral surface 30*a* of the plate cylinder 30.

The distal end of the second bent portion 712 is provided so as to be positioned on the upstream side of the lower end of the lower guide portion 63 in the guide 60 in the transport direction.

[1-2-2-3. Controller]

The controller 90 performs a mist supply control which the supply amount of the mist supplied by the moisture supply unit 50, and a water supply-drainage control which operates a pump P (refer to FIG. 3) based on the information of the water level in the storage portion 51 transmitted from the water level sensor 80.

<Mist Supply Control>

In the mist supply control, in a case where there is a possibility that the amount of the moisture on the printing plate surface 31*a* in the post-ink transfer region $R_1$ is insufficient, the ultrasonic mist generator 52 and the fan 54 are continuously or intermittently operated (ON-OFF), and mist is supplied into the post-ink transfer region $R_1$. In the mist supply control, mist is generated above the water surface in the storage portion 51 by the ultrasonic mist generator 52, and the mist flows through the communication portion 53 by blowing of the fan 54 so as to be supplied into the post-ink transfer region $R_1$.

Whether or not there is a possibility that the amount of the moisture on the printing plate surface 31*a* is insufficient is determined based on the temperature and humidity detected by the temperature-humidity sensor 81. For example, it may be that there is a possibility that the amount of the moisture on the printing plate surface 31*a* is insufficient when the detected temperature is a predetermined temperature or more or the detected humidity is predetermined humidity or less.

Here, each of the predetermined temperature and the predetermined humidity is a threshold value which determines whether or not the printing plate surface 31*a* in the post-ink transfer region $R_1$ is dry, and is preset experimentally or empirically. In addition, a combination (map) of a predetermined temperature and predetermined humidity at which the printing plate surface 31*a* may be dried is stored in the controller 90, and the ultrasonic mist generator 52 and the fan 54 may be operated based on the map.

For example, in the mist supply control, the generated amount of the mist generated by the ultrasonic wave generator 52 may increase as the detected temperature is higher than the predetermined temperature and the detected humidity is lower than the predetermined humidity so as to increase the amount of air blown by the fan 54. A map in which the detected temperature and the detected humidity are combined with the predetermined temperature and the predetermined humidity according to the characteristics may be stored in the controller 90. That is, for example, the mist supply control may be a feedback control based on the temperature and the humidity detected by the temperature-humidity sensor 81 using the map.

In addition, when decorative printing in which the line number of the printing plate 31*a* increases is performed, the predetermined temperature may be set to a low temperature side in comparison with the normal printing, and the predetermined humidity may be set to a high humidity side in comparison with the normal printing. The reason is because the line number of the printing plate 31 is increased and the rotating speed of the plate cylinder 30 is decreased in the decorative printing, the supply amount of the ink supplied to the printing plate 31 is decreased, the evaporation time of the ink is extended, and the printing plate surface 31*a* is easily dried. Accordingly, the predetermined temperature or the predetermined humidity may be variably set as the line number of the printing plate 31 increases or as the rotating speed of the plate cylinder 30 decreases.

In addition, here, the controller 90 uses either the temperature or the humidity detected by the temperature-humidity sensor 81. However, the controller 90 may perform the mist supply control using the temperature or the humidity detected by the temperature-humidity sensor 81.

<Water Supply-Drainage Control>

In the water supply-drainage control, the amount of the water stored in the storage portion 51 is adjusted. Specifically, if the water level detected by the water level sensor 81 is a predetermined water level or less, the pump P is operated, and the control of the water supplied into the storage portion 51 is performed. Here, the predetermined water level is a water level at which mist can be stably generated by the ultrasonic mist generator 52, and is preset experimentally or empirically. Accordingly, the predetermined water level is set so as to be higher than the water level at which the ultrasonic mist generator 52 is exposed from the water, and is set to a water level which is lower than the fan 54.

Moreover, in the water supply-drainage control, for example, the drainage control of operating the pump P is also performed when water is drained from the storage portion 51 or the water tank 59 by the instruction of an operator.

[2. Effects]

Since the flexographic printer according to the first embodiment of the present invention and the box-making machine having the same are configured as described above, the following effects can be obtained.

Although the printing plate surface 31*a* in the post-ink transfer region $R_1$ is easily dried particularly in a case where the line number of the printing plate 31 increases, since the moisture supply unit 50 supplies mist to the printing plate surface 31*a* in the post-ink transfer region $R_1$, the moisture evaporated from the printing plate surface 31*a* is offset by the mist supplied by the moisture supply unit 50, and it is possible to prevent drying of the printing plate surface 31*a*. Accordingly, it is possible to maintain the printing plate surface 31*a* in a favorable moisture retaining state, and it is possible to ensure a print quality even in a case where the line number of the printing plate 31 increases. For example, it is possible to ensure a desired quality even when full-color printing is performed using CMYK ink.

In addition, since mist is supplied to the post-ink transfer region $R_1$, the atmosphere of the printing plate surface 31*a* is humidity-adjusted and the mist is supplied to the printing plate surface 31*a*, even when mist is not directly supplied to the printing plate surface 31*a*, it is possible to prevent drying of the printing plate surface 31*a*, and it is possible to ensure a print quality even in a case where the line number of the printing plate 31 increases.

If the printing plate surface 31*a* is dried, when the flexographic printer is operated again, it is necessary to clean ink from the printing plate surface 31*a*, which increases a burden on an operator. Moreover, since the flexographic printer is applied to the box-making machine, it is necessary to stop the entire box-making line, which lowers productivity. In addition, in order to prevent drying of the printing plate surface 31*a*, it is necessary to add a drying retardant to ink or manage the ink viscosity to deal with it, which also increases a burden on an operator. Meanwhile, according to the flexographic printer of the present embodiment, since it is possible to prevent drying of the printing plate surface 31*a*, it is possible to decrease a burden on an operator, and it is possible to improve productivity.

Since the guide 60 which covers the post-ink transfer region $R_1$ from the outside of the plate cylinder and guides moisture supplied by the moisture supply unit 50 to the printing plate surface 31*a* is provided, it is possible to prevent diffusion of the mist supplied into the post-ink transfer region $R_u$ and it is possible to effectively supply mist to printing plate surface 31*a*.

Since the tray 70 which receives water droplets attached to the guide 60 is provided, the mist supplied into the post-ink transfer region $R_1$ is attached to the guide 60 and agglomerates to form large water droplets, and even if the water droplets are dropped, the water droplets can be received by the tray 70, and it is possible to prevent water droplets from being attached to the corrugated fiberboard S.

If the site of the corrugated fiberboard S to which water droplets are dropped is printed by another flexographic printer (print unit), ink is not favorably transferred, and there is a possibility that print quality deteriorates. Meanwhile, since the tray 70 is provided in the flexographic printer of the present embodiment, it is possible to prevent water droplets from being attached to the corrugated fiberboard S, and it is possible to improve a print quality.

Since the drain port 78 through which collected water droplets are drained is formed in the horizontal portion 71*a* of the tray 70 and the drain pipe 79 is connected to the drain port 78, it is possible to appropriately treat the water droplets collected by the tray 70.

The distal end of the second bent portion 712 in the tray 70 is provided so as to be positioned on the upstream side of the lower end of the lower guide portion 63 in the guide 60 in the transport direction. Accordingly, when the water droplets move along the guide 60 and are dropped, the tray 70 can reliably receive the water droplets. In addition, since the second bent portion 712 is disposed along the peripheral surface 30*a* of the plate cylinder 30, the second bent portion 712 functions as a cover which covers the post-ink transfer region $R_1$ from the outside of the plate cylinder 30, it is possible to prevent diffusion of mist supplied into the post-ink transfer region $R_1$, and it is possible to effectively supply mist to printing plate surface 31*a*.

Since the second bent portion 712 which is provided above the first bent portion 711 is provided so as to be positioned on the upstream side of the lower end of the lower guide portion 63 in the guide 60 in the transport direction, it is possible to prevent the water droplets dropped from the guide 60 from being scattered on the printing plate surface 31*a*. Specifically, since the second bent portion 712 catches jumping when the water droplets from the lower end of the lower guide portion 63 in the guide 60 are dropped on the first bent portion 711 and collide with the first bent portion 711, it is possible to prevent the water droplets from being attached to the printing plate surface 31*a*.

Since the guide 60 and the tray 70 are separately provided from each other, it is possible to detach and attach them independently from each other, and it is possible to improve maintainability.

Since the moisture supply unit 50 includes the storage portion 51 in which water is stored, the ultrasonic mist generator 52 which atomizes the water in the storage portion 51 by ultrasonic waves, and the communication portion 53 which communicates with the storage portion 51 and the post-ink transfer region $R_1$, it is possible to effectively atomize the water stored in the storage portion 51 by the ultrasonic mist generator 52, and it is possible to supply mist to the post-ink transfer region $R_1$ through the communication portion 53.

For example, in a case a device which heats water so as to generate steam is used, there is a possibility that moisture is evaporated from the printing plate surface 31*a* due to the heat emitted from the device. Meanwhile, in the flexographic printer of the present embodiment, since mist is generated by the ultrasonic mist generator 52, it is possible to decrease the heat emitted from the device, which contributes to prevention of drying of the printing plate surface 31*a*.

Since the mist generated by the ultrasonic mist generator 52 is fed to the communication passage 53 by air blown from the fan 54, the mist is effectively fed to the post-ink transfer region $R_1$ through the communication portion 53, and it is possible to effectively prevent drying of the printing plate surface 31*a* in the post-ink transfer region $R_1$.

Since the communication portion 53 has a shape which rises and is inclined as the communication portion approaches the post-ink transfer region $R_1$, even when mist is attached to the inside of the communication portion 53 and agglomerates to form large water droplets, it is possible to make the water droplets to flow toward the storage portion 51. In addition, since the communication portion 53 has the curved crank structure, even when large water droplets flows from the storage portion 51 to the communication portion 53, the water droplets are attached to the curved site of the communication portion 53. Specifically, it is possible to make the water droplets to flow downward in the first communication portion 53*a* and the third communication portion 53*c* having inclined shapes. In addition, the water droplets can be attached to the curved sites of the inner wall of the second communication portion 53*b* which is connected to intersect the first communication portion 53*a* or the inner wall of the third communication portion 53*c* which is connected to intersect the second communication portion 53*a*, and the water droplets can flow downward or can be dropped.

Accordingly, it is possible to prevent large water droplets from flowing to the post-ink transfer region $R_1$, it is possible to prevent the water droplets from being attached to the printing plate 31 or the corrugated fiberboard S, which contributes to improvement of a print quality.

If the drain port is provided in the communication portion 53 and the drain pipe is connected to the drain port, it is possible to rapidly discharge large water droplets attached to the communication portion 53 to the outside.

It is possible to appropriately supply moisture to the printing plate surface 31*a* by the controller 90 which controls the supply amount of the mist supplied by the moisture supply unit 50 based on the temperature and the humidity detected by the temperature-humidity sensor 81, it is possible to reliably ensure a print quality. In addition, since the water supply-drainage control is performed by the controller 90, it is possible to reduce a burden on an operator with respect to the water supply-drainage.

Since the corrugated fiberboard S is transported while being suctioned, for example, in a technology which supplies mist into a closed space which surrounds the entire plate cylinder 30, the mist is easily suctioned. Meanwhile, in the flexographic printer of the present embodiment, since the guide 60 covers the post-ink transfer region $R_1$ without closing (sealing) the post-ink transfer region $R_1$ from the outside of the plate cylinder 30, the structure which covers the pre-ink transfer region $R_2$ is not provided. Accordingly, the corrugated fiberboard S is stably transported, the mist can be fastened to the post-ink transfer region $R_1$, and it is possible to effectively supply moisture to the printing plate surface 31*a*.

Since the flexographic printer of the present embodiment performs printing using water ink, the flexographic printer of the present invention can be applied to general flexographic printer in which water based ink is widely used. In this case, the above-described effects can be obtained by only adding components such as the moisture supply unit 50, the cover 60, and the tray 70. Similarly, the above-described effects can be obtained by only applying the flexographic printer of the present embodiment to the print unit of a general box-making machine.

Since the dry units $B_{21}$, $B_{22}$, $B_{23}$, and $B_{24}$ provided on the immediately downstream of the print units $B_{11}$, $B_{12}$, $B_{13}$, $B_{14}$ to which the flexographic printer is applied, there is a possibility that evaporation of moisture from the printing plate surface 31*a* is promoted due to heat emitted from the dry units $B_{21}$, $B_{22}$, $B_{23}$, and $B_{24}$. Even in the situation in which the moisture of the printing plate surface 31*a* is easily evaporated, the drying of the printing plate surface 31*a* is prevented by the moisture supply unit 50 or the like, and it is possible to ensure a print quality.

In addition, if the dry units are omitted, the heat emitted from respective dry units is not generated, and the drying of the printing plate surface 31*a* is reliably prevented.

[I'. Modification of First Embodiment]

Next, a modification example according to the first embodiment of the present invention will be described with reference to FIG. 5.

In the present modification example, the configuration of a moisture supply unit 150 is different from the configuration of the above-described moisture supply unit 50.

Specifically, the configuration of a storage portion 151 corresponding to the above-described storage portion 51 is different from that of the storage portion 51, the configuration of a water tank 159 corresponding to the above-described water tank 59 is different from that of the water tank 59, and the above-described water level sensor 80 or the controller 90 according to the water supply-drainage control is not used. The configurations of the modification example are different from those of the first embodiment except for the above-described configurations, similar reference numerals are assigned to those, and descriptions thereof are omitted.

[1. Configuration]

First, the configurations of the storage portion 151 and the water tank 159 will be described in this order.

<Storage Portion>

Figure 5A:
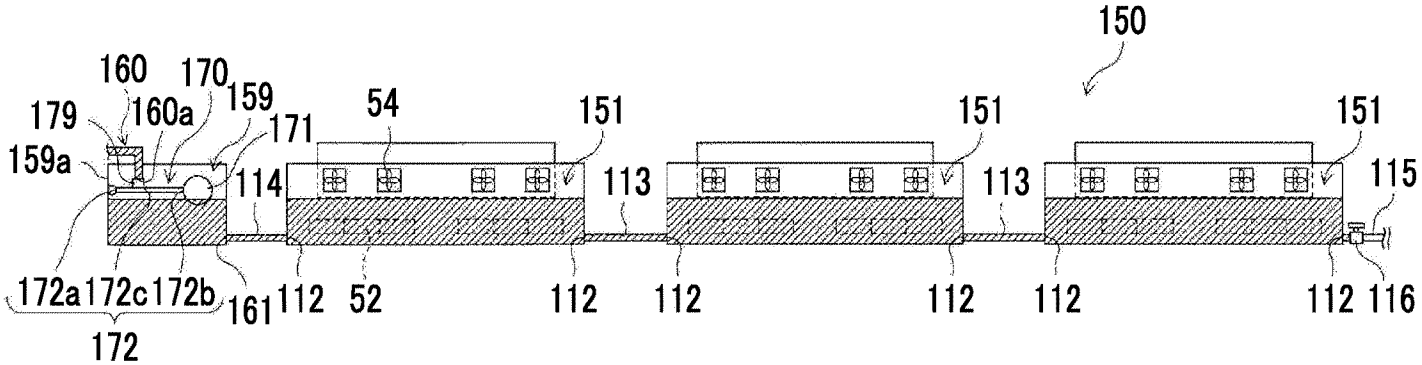
FIGS. 5A, 5B, and 5C are rear views when a configuration of a moisture supply unit (ink solvent supply unit) of a flexographic printer according to a modification example of the first embodiment of the present invention is extracted and is viewed from the rear surface (the downstream in a transport direction) side.

As shown in FIG. 5A, a water-flow portion (hereinafter, referred to as a "lower water-flow port") 112 is provided below the storage portion 151. Here, the lower water-flow ports 112 are respectively provided on both end portions in the width direction of each storage portion 151. In addition, in the storage portion 151, a water-flow port is not provided above the lower water-flow port 112.

Similarly to the above-described storage portion 51, the storage portion 151 stores the water for ink solvent (indicated by oblique lines), a plurality of (here, three) storage portions 151 are provided in the width direction, and the lower water-flow ports 112 of the storage portions 151 adjacent to each other in the width direction are connected to each other via a water supply pipe 113 between storage portions. In addition, similarly to the storage portion 51, in each storage portion 151, fans 54 (the reference numeral is assigned to only one fan), blowers (not shown), or ultrasonic mist generators 52 (the reference numeral is assigned to only one ultrasonic mist generator) are provided.

In the storage portion 151 which is disposed on one end side (the left sides in FIGS. 5A to 5C) in the width direction, the lower water supply port 112 on one side in the width direction is connected to the water tank 159 via the tank water supply pipe 114. Since the tank water supply pipe 114 and the water supply pipe 113 between storage portions communicate with each other in a state where a valve is not interposed, the water level of the storage portion 151 and the water level of the water tank 159 are interlocked with each other so as to be the same water level.

In addition, in the storage portion 151 which is disposed on the other side (the right sides in FIGS. 5A to 5C) in the width direction, a drain pipe 115 is connected to the lower water supply port 112 on the other end side in the width direction. A drain valve 116 is provided in the drain pipe 115.

<Water Tank>

The water tank 159 stores water which is supplied to the storage portion 151.

A water supply pipe 160 is connected to the upper portion of the water tank 159, and the tank water supply pipe 114 is connected to a water-flow port 161 positioned on the lower portion of the water tank 159 (hereinafter, referred to as a "lower water-flow port"). In addition, a float 170 is provided in the water tank 159. In addition, a water supply source (not shown) is connected to the upstream of the water supply pipe 160.

The float 170 includes a float body portion 171 which floats on water stored in the water tank 159, and a rigid float shaft 172 which is connected to the float body portion 171 and a vertical wall portion 159*a* of the water tank 159.

Since the float body portion 171 floats on water stored in the water tank 159, the float body portion 171 is displaced upward and downward according to the water level. The buoyant force of the float body portion 171 is set to be larger than the water supply pressure from the water supply pipe 160.

A proximal end portion 172*a* of the float shaft 172 is swingably connected to the vertical wall portion 159*a* of the water tank 159, and a distal end portion 172*b* of the float shaft 172 is connected to the float body portion 171. Accordingly, if the float body portion 171 is displaced upward and downward according to the water level of the water tank 159, the float body portion 171 and the float shaft 172 are swung with the proximal end portion 172*a* of the float shaft 172 as a supporting point.

In the float shaft 172, a drain stopper 179 is provided at an intermediate portion 172*c* between the proximal end portion 172*a* and the distal end portion 172*b*.

Figure 5B:
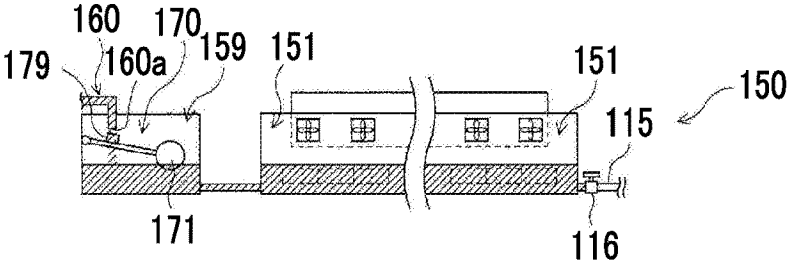

The drain stopper 179 stops the water supply from the water supply pipe 160. That is, the drain stopper 179 closes a water supply port 160*a* on the downstream end of the water supply pipe 160 to stop the water supply from the water supply pipe 160. Specifically, as shown in FIG. 5A, the drain stopper 179 closes the water supply port 160*a* if the water level of the water tank 159 rises, and as shown in FIG. 5B, the drain stopper 179 opens the water supply port 160*a* if the water level of the water tank 159 is lowered.

Accordingly, the drain stopper 179 is provided so as to correspond to the position of the water supply port 160*a* of the water supply pipe 160.

Here, the drain stopper 179 is provided at the position at which the water supply port 160*a* is closed when the water level of the water tank 159 is positioned at a predetermined water level. Here, the predetermined water level may use a water level similar to the predetermined water level which is used to control the water supply in the above-described first embodiment.

[2. Effects]

Hereinafter, the water supply-drainage of the moisture supply unit 150 will be described.

First, the water supply when the moisture supply unit 150 is operated will be described with reference to FIGS. 5A and 5B. In addition, when the moisture supply unit 150 is operated, water is supplied to the water supply pipe 160 from a water supply source (not shown), and the drain valve 116 is closed.

When the moisture supply unit 150 is operated, mist generated from the water in the storage portion 151 by the ultrasonic mist generator 52 or the fan 54 is supplied to the post-ink transfer region $R_1$ (refer to FIGS. 1 and 2). Accordingly, as shown in FIG. 5B, the water level in the storage portion 151 is lowered, and the water level of the water tank 159 is also lowered interlockingly with this.

If the water level of the water tank 159 is lowered, the float body portion 171 of the float 170 is displaced downward, and the float shaft 172 is swung downward. At this time, since the drain stopper 179 provided in the intermediate portion 172*c* of the float shaft 172 is also displaced downward, the closed water supply port 160*a* of the water supply pipe 160 is opened, and water is supplied to the water tank 159 via the water supply pipe 160.

If the water level of the water tank 159 is increased by the water supply and for example, the water level becomes a predetermined water level, as shown in FIG. 5A, the water level of the water tank 159 increases, and the water level of the storage portion 151 is also increased interlockingly with this.

If the water level of the water tank 159 increases, the float body portion 171 of the float 170 is displaced upward, and the float shaft 172 is swung upward. At this time, since the drain stopper 179 which is provided in the intermediate portion 172*c* of the float shaft 172 is also displaced upward, the opened water supply pipe 160*a* of the water supply port 160 is closed, and the water supply with respect to the water tank 159 is stopped.

In this way, the water supply and the water supply stop with respect to the water tank 159 are performed by the float 170 which is swung upward and downward interlockingly with the water level of the water tank 159.

Figure 5C:
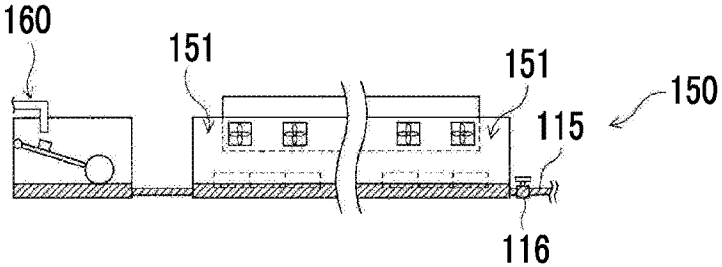

Next, drainage when the moisture supply unit 150 is stopped will be described with reference to FIG. 5C. The drainage is performed after the water supply from the water supply source connected to the water supply pipe 160 is stopped, and for example, is performed at the time of maintenance of the moisture supply unit 150, or the like.

When the moisture supply unit 150 is stopped, for example, the drain valve 116 is opened by an operator. Accordingly, the water inside each of the storage portion 151 and the water tank 159 is discharged from the drain pipe 115. Therefore, the water level of the storage portion 151 is lowered, and the water level of the water tank 159 is also lowered interlockingly with this. Accordingly, it is possible to drain water from the storage portion 151 and the water tank 159.

Since the flexographic printer according to the modification example of the first embodiment of the present invention has the above-described configuration, the above-described effects can be obtained.

In the present modification example, since the water supply and the water supply stop with respect to the water tank 159 are performed according to the float 170 which is swung upward and downward interlockingly with the water level (is the same as the water level of the storage portion 151) of the water tank 159, the water level sensor used in the above-described water supply-drainage control or the controller 90 according to the water supply-drainage control can be omitted, and a simple configuration can be realized. Accordingly, it is possible to ensure a print quality while preventing an increase in cost.

II. Second Embodiment

[1. Configuration]

Figure 6:
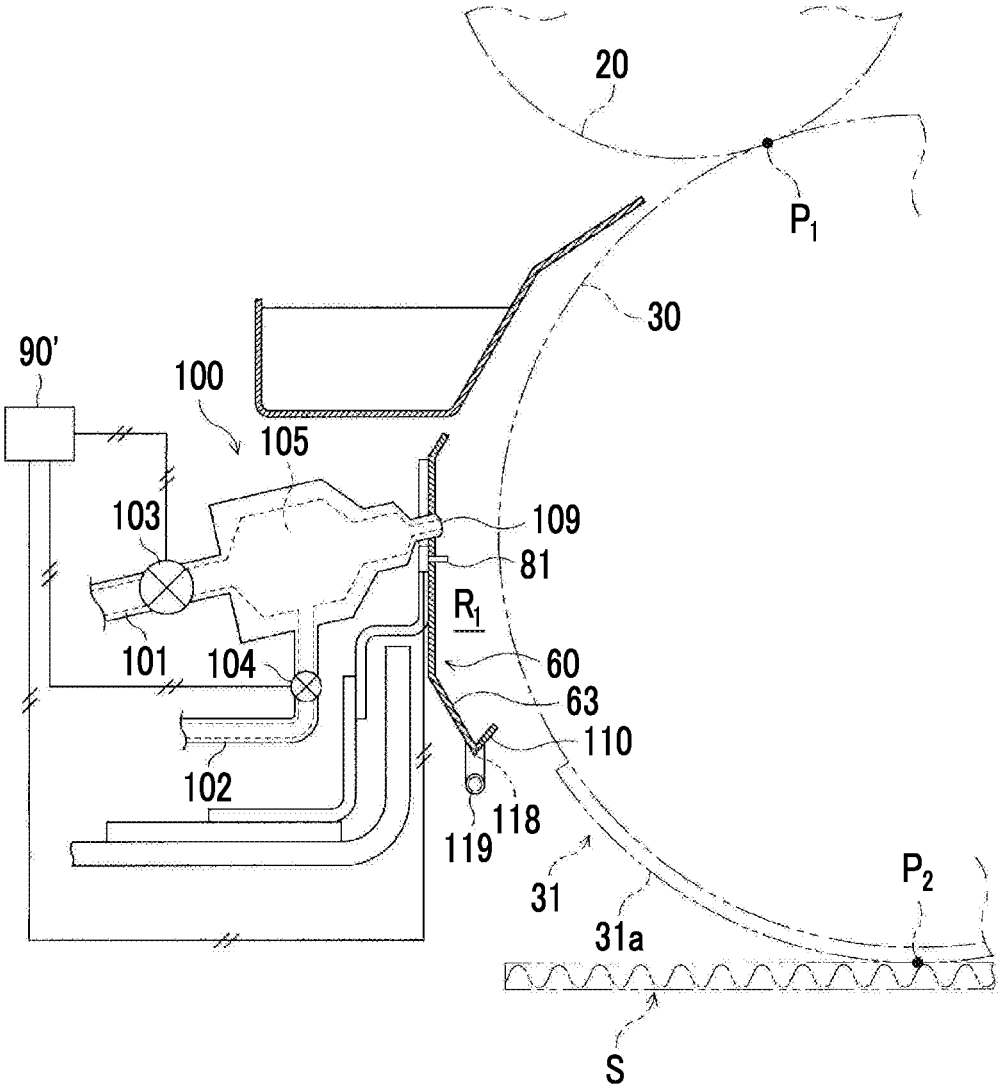
FIG. 6 is a side view showing a main portion of a flexographic printer according to a second embodiment of the present invention, and shows sites corresponding to those of FIG. 2.

Next, a second embodiment of the present invention will be described with reference to FIG. 6.

A configuration of a flexographic printer according to the second embodiment of the present invention is different from that of the flexographic printer of the first embodiment in that a two-fluid sprayer 100 is provided as an ink solvent supply unit at the site corresponding to the moisture supply unit 50 of the first embodiment, and a tray 110 of the second embodiment is different from that of the first embodiment. The second embodiment is configured so as to be the same as the first embodiment except for this, and accordingly, the same reference numerals are assigned to the same configurations, and descriptions thereof are omitted. In addition, for easy understanding, in FIG. 6, the two-fluid sprayer 100 is shown so as to be schematically enlarged.

<Two-Fluid Sprayer>

In the two-fluid sprayer 100, two fluids such as air and water are mixed with each other from the injection port 109 and the mixture is sprayed. The injection port 109 is provided so as to penetrate the guide 60 and protrude toward the post-ink transfer region $R_1$. Accordingly, mist from the injection port 109 is supplied to the post-ink transfer region $R_1$.

In the two-fluid sprayer 100, an air supply pipe 101 through which air is supplied and a water supply pipe 102 through which water is supplied are connected to each other. On/off valves 103 and 104 are respectively provided in the air supply pipe 101 and the water supply pipe 102. In addition, a plurality of two-fluid sprayers 100 are provided so as to be arranged in the width direction.

A space (hereinafter, referred to as an "internal space") 105 (indicated by a broken line) is formed in the two-fluid sprayer 100. If the on/off valves 103 and 104 are opened, in the internal space 105, water from the water supply pipe 102 is suctioned by the air supplied from the air supply pipe 101 and atomized such that atomization is performed by a so-called carburetor or atomizer. In this way, the mixture in which mist is mixed with air is sprayed from the injection port 102.

Each of the on/off valves 103 and 104 is connected to a controller 90' via a control line. The controller 90' controls opening and closing of each of the on/off valves 103 and 104 based on the temperature or humidity detected by the temperature-humidity sensor 81.

Specifically, in a case where there is a possibility that the amount of moisture on the printing plate surface 31*a* in the post-ink transfer region $R_1$ is insufficient, the controller 90' opens any one of the on/off valves 103 and 104 to perform the mist supply control which supplies mist into the post-ink transfer region $R_1$.

As described in the first embodiment, the determination whether or not there is a possibility that the amount of moisture on the printing plate surface 31*a* is insufficient is performed based on the temperature and humidity detected by the temperature-humidity sensor 81.

In addition, each of the on/off valves 103 and 104 may adopt an on/off valve which can adjust an opening degree. In this case, in the mist supply control, it is possible to increase the spraying amount by adjusting the opening degree of each of the on/off valves 103 and 104 as the detected temperature becomes higher than a predetermined temperature and the detected humidity becomes lower than a predetermined humidity.

<Tray>

The tray 110 is integrally provided with the guide 60. The tray 110 has a shape which is positioned to rise as it approaches the plate cylinder 30 from the lower guide portion 63 in the guide 60.

In addition, the connection site between the tray 110 and the guide 60 is a site which has the lowest vertical height in the tray 110 and the guide 60, a drain port 118 through which water droplets collected by the tray 110 is drained is provided at this site, and a drain pipe 119 is connected to the drain port 118.

[2. Effects]

Since the flexographic printer according to the second embodiment of the present invention has the above-described configuration, the following effects can be obtained.

Since the two-fluid sprayer 100 is provided in which two fluids such as air and water are mixed with each other and the mixture is sprayed to the post-ink transfer region R1 from the injection port 109, it is possible to ensure a print quality even in a case where the line number of the printing plate 31 increases by supplying moisture to the printing plate surface 31*a*.

In addition, since the plurality of two-fluid sprayers 100 are provided so as to be arranged in the width direction, it is possible to uniformly supply moisture to the printing plate surface 31*a*. It is possible to reliably ensure a print quality.

Sine the guide 60 an the tray 110 are integrally provided with each other, the configuration can be simple, and it is possible to decrease a manufacturing cost or a material cost.

III. Others

Hereinbefore, the embodiments of the present invention are described. However, the present invention is not limited to the above-described embodiments, and can be performed so as to be variously modified within a scope which does not depart from the gist of the present invention. The configurations of the above-described embodiments can be appropriately selected if necessary, and may be appropriately combined.

A movement mechanism which reciprocates the two-fluid sprayer 100 in the width direction may be further provided, and the two-fluid sprayer 100 may be configured so as to be moved. In this case, it is possible to uniformly supply moisture to the printing plate surface 31*a* even when the installation number of the two-fluid sprayers 100 is reduced.

Moreover, the moisture supply unit 50 and the two-fluid sprayer 100 may be used so as to be combined. For example, the moisture supply unit 50 and the two-fluid sprayer 100 are provided so as to be arranged in the width direction or the vertical direction. In this way, the moisture supply unit 50 and the two-fluid sprayer 100 are together used, the entire post-ink transfer region $R_1$ is humidified by the moisture supply unit 50, the printing plate surface 31*a* is partially humidified by the two-fluid sprayer 100, and it is possible to more effectively prevent the drying of the printing plate surface 31*a*.

In addition, the corrugated fiberboard S may be transferred without being suctioned. In this case, stability of the transport of the corrugated fiberboard S decreased. However, a simple configuration can be realized.

In addition, the controllers 90 and 90' may be omitted. In this case, a monitor (display portion) is provided, which displays the water level, the temperature, or the humidity detected by the water level sensor 80 or the temperature-humidity sensor 81, and an operator can adjust the water supply-drainage, the generation amount of mist, and the feed amount of air based on the display. According to this configuration, it is possible to realize a simple configuration, and it is possible to reduce the cost of device. Moreover, the temperature-humidity sensor 81 may be omitted. In this case, a simpler configuration can be realized. It is possible to further reduce the cost of device.

In addition, the communication portion 53 in the flexographic printer of the first embodiment may extend in the horizontal direction, and may be linearly formed without being curved. In this case, water droplets easily flow into the post-ink transfer region $R_1$. However, it is possible to reduce the manufacturing cost of the communication portion 53.

In addition, the fan 54 in the flexographic printer of the first embodiment may be omitted. In this case, supplying efficiency of mist is decreased. However, the fan opening portion 513 and the suction opening portion 515 in the storage portion 51 can be omitted, a simple configuration can be realized, and it is possible to reduce the cost of device.

In addition, in the flexographic printer of the first embodiment, a device which heats water stored in the storage portion 51 so as to generate steam (ink solvent) may be used in addition to or instead of the ultrasonic mist generator 52. In this case, although influence of heat emitted from the steam generation device is generated, it is possible to generate steam using a general humidification unit.

In addition, the trays 70 and 110 may be omitted. In this case, even when there is a possibility that the water droplets are dropped from the guide 60, a simple configuration can be realized, and it is possible to reduce the cost of device. Moreover, the guide 60 may be omitted. In this case, although when the mist supplied to the post-ink transfer region $R_1$ is easily diffused, a simple configuration is realized, and it is possible to reduce the cost of device.

In addition, in the flexographic printer, water based ink is not used, and an UV ink or an oil based ink may be used. In a case where an UV ink or an oil based ink, the dry unit is changed from a heating type unit to an UV irradiation type unit, it is possible to prevent the amount of the moisture on the printing plate surface 31 from being insufficient due to heat emitted from the dry unit. In addition, in a case where an oil based ink is used, an organic solvent is used as the ink solvent.

In addition, the flexographic printer is not limited so as to be applied to the box-making machine, and the flexographic printer may be singularly used.

In addition, in the embodiments, the corrugated fiberboard is exemplified as the object to be printed. However, the present flexographic printer can be applied so as to print various sheet kinds.

REFERENCE SIGNS LIST

10: ink chamber
11: doctor blade
20: anilox roll
20*a*: peripheral surface
29: ink receiving pan
291: plate cylinder-side surface portion
30: plate cylinder
30*a*: peripheral surface
31: printing plate (letterpress)
31*a*: surface (printing plate surface)
39: receiving roll
50: moisture supply unit (ink solvent supply unit)
51: storage portion
511: upper water-flow port
512: lower water-flow port
513: fan opening portion
514: duct opening portion
52: ultrasonic mist generator
53: communication portion
531: storage portion-side opening portion
532: plate cylinder-side opening portion
53*a*: first communication portion
53*b*: second communication portion
53*c*: third communication portion
54: fan (blowing unit)
59: water tank
60: guide
61: upper guide portion
62: intermediate guide portion
63: lower guide portion
70: tray
71: tray portion
71*a*: horizontal portion
72*a*: bent portion
711: first bent portion
712: second bent portion
72: attachment portion
78: drain port
79: drain pipe
80: water level sensor
81: temperature-humidity sensor
90, 90': controller
100: two-fluid sprayer (ink solvent supply unit)
101: air supply pipe
102: water supply pipe
103, 104: on/off valve
105: internal space
109: injection port

110: tray
150: moisture supply unit (ink solvent supply unit)
151: storage portion
112: lower water-flow port
113: water supply pipe between storage portions
114: tank water supply pipe
115: drain pipe
116: drain valve
158: water supply pipe
159: water tank
159*a*: vertical wall portion
160: water supply pipe
160*a*: water supply port
161: lower water-flow port
170: float
171: float body portion
172: float shaft
172*a*: proximal end portion
172*b*: distal end portion
172*c*: intermediate portion
179: drain stopper
a: arrow (transport direction)
b: ruled line
c: groove
d: adhesion piece
e: side plate
A: paper feed section
B: print section
$B_{11}$, $B_{12}$, $B_{13}$, $B_{14}$: print unit
$B_{21}$, $B_{22}$, $B_{23}$, $B_{24}$: dry unit
C: slotter-creaser section
D: die-cut section
E: folder-gluer section
F: counter-ejector section
$G_1$: corrugated fiberboard group
$G_2$: corrugated box group
$P_1$: ink supply site
$P_2$: ink transfer site
$R_1$: post-ink transfer region
$R_2$: pre-ink transfer region
S: corrugated fiberboard
W: corrugated box
$\theta_1$: ink supply phase
$\theta_2$: ink transfer phase

The invention claimed is:

1. A flexographic printer, comprising:

a printing plate which transfers ink at an ink transfer site to an object to be printed;

an anilox roll which supplies ink to the printing plate at an ink supply site;

a plate cylinder around which the printing plate is wound and rotated;

an ink solvent supply unit which supplies a solvent for ink to the surface of the printing plate in a post-ink transfer region which is a downstream of the ink transfer site in a rotation direction of the plate cylinder and an upstream of the ink supply site in the rotation direction of the plate cylinder; and a guide which covers the post-ink transfer region from the outside of the plate cylinder and guides the solvent for ink supplied by the ink solvent supply unit to the surface of the printing plate without covering a pre-ink transfer region which is downstream of the ink supply site in the rotation direction of the plate cylinder and upstream of the ink transfer site in the rotation direction of the plate cylinder.

2. The flexographic printer according to claim 1, further comprising:

a tray which receives the solvent for ink attached to the guide.

3. The flexographic printer according to claim 2, wherein the guide and the tray are separately provided from each other.

4. The flexographic printer according to claim 2, wherein the guide and the tray are integrally provided with each other.

5. The flexographic printer according to claim 1, wherein the ink solvent supply unit includes a storage portion in which the solvent for ink is stored, an ultrasonic mist generator which atomizes the solvent for ink in the storage portion by ultrasonic waves, and a communication portion which communicates with the storage portion and the post-ink transfer region.

6. The flexographic printer according to claim 5, further comprising:

a blowing unit which feeds the solvent for ink atomized by the ultrasonic mist generator to the communication portion.

7. The flexographic printer according to claim 5, wherein the communication portion has a shape which rises and is inclined as the communication portion approaches the post-ink transfer region.

8. The flexographic printer according to claim 5, wherein the communication portion has a curved crank structure.

9. The flexographic printer according to claim 1, wherein the ink solvent supply unit includes a two-fluid sprayer which mixes two fluids of the solvent for ink and gas with each other and sprays the mixture.

10. The flexographic printer according to claim 1, further comprising:

a temperature-humidity sensor which detects a temperature or humidity of the post-ink transfer region.

11. The flexographic printer according to claim 10, further comprising:

a controller which controls a supply amount of the solvent for ink supplied by the ink solvent supply unit based on the temperature or humidity detected by the temperature-humidity sensor.

12. The flexographic printer according to claim 1, wherein printing is performed using water based ink.

13. The flexographic printer according to claim 1, wherein the object to be printed is transported while being suctioned.

* * * * *